United States Patent [19]

Mulder et al.

[11] Patent Number: 4,656,844

[45] Date of Patent: Apr. 14, 1987

[54] CENTRIFUGAL DISPENSER FOR AUTOMATIC WASHER WITH HIGH SPEED SPIN

[75] Inventors: James R. Mulder, Berrien Township, Berrien County; Joel M. Snider, Lincoln Township, Berrien County, both of Mich.

[73] Assignee: Whirlpool Corporation, Benton Harbor, Mich.

[21] Appl. No.: 688,380

[22] Filed: Jan. 2, 1985

[51] Int. Cl.[4] ..... D06F 35/00

[52] U.S. Cl. ..... 68/17 A; 403/341

[58] Field of Search ..... 68/17 A; 403/341, 373, 403/377

[56] References Cited

U.S. PATENT DOCUMENTS

| | | | |
|---|---|---|---|
| 2,448,817 | 9/1948 | McArthur | 403/341 X |
| 2,862,993 | 12/1958 | Schmidt | 403/341 X |
| 3,091,108 | 5/1963 | Martin et al. | 68/17 A |
| 3,248,914 | 5/1966 | Tingley, Jr. | 68/17 A X |
| 3,306,084 | 2/1967 | Bullock | 68/17 A |
| 3,316,741 | 5/1967 | Harlow et al. . | |
| 3,334,499 | 8/1967 | Cartwright | 68/17 A X |
| 3,370,444 | 2/1968 | Wolters . | |
| 3,520,156 | 7/1970 | Douglas | 68/17 A |
| 3,620,054 | 11/1971 | Drews et al. . | |
| 4,118,957 | 10/1978 | Marcussen . | |
| 4,186,574 | 2/1980 | Sundstrom | 68/17 A |
| 4,240,277 | 12/1980 | Manthei | 68/17 A |

*Primary Examiner*—Harvey C. Hornsby
*Assistant Examiner*—Frankie L. Stinson

[57] ABSTRACT

A centrifugal liquid additive dispenser is provided for an automatic washer having a high stroke rate oscillating vertical agitator and a high spin speed which is readily assembled onto and removed from the agitator by means of a deformable annular wall with inwardly projecting buttons which engage below a lip on the agitator and are held in a locked position by a movable locking ring. The dispenser has a cup which is designed to prevent the dispensing of liquid below a rotational speed of 300 R.P.M.

25 Claims, 7 Drawing Figures

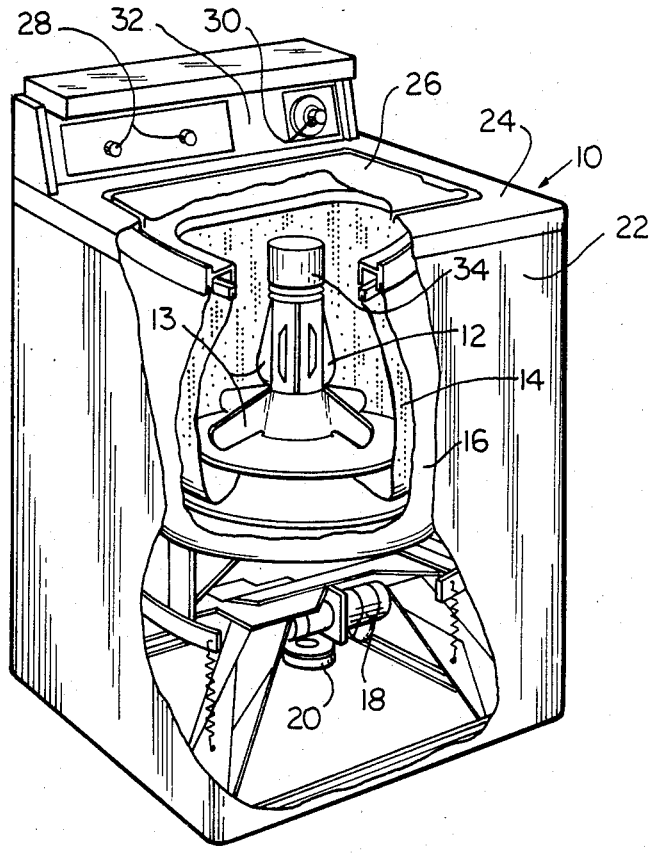
FIG 1
FIG 2
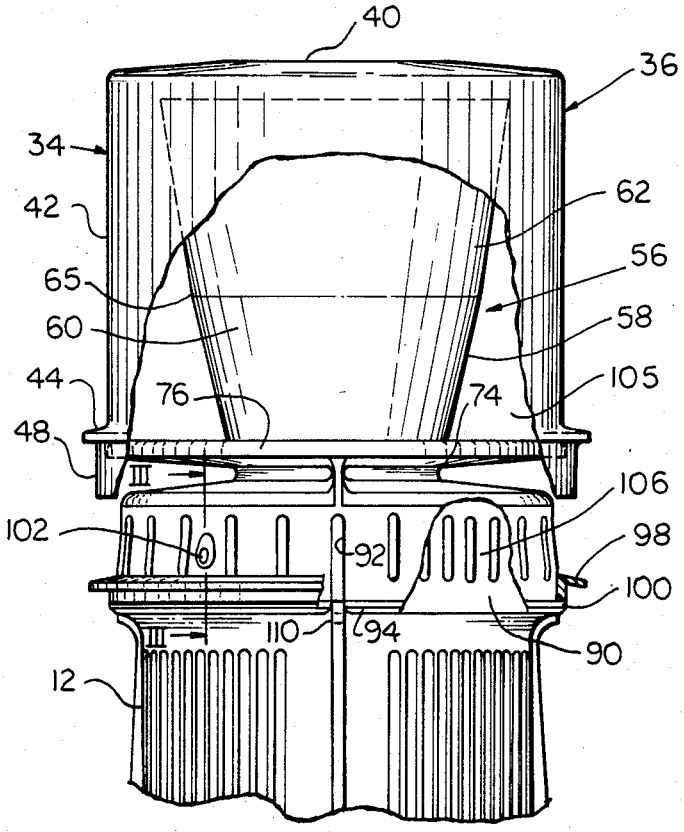
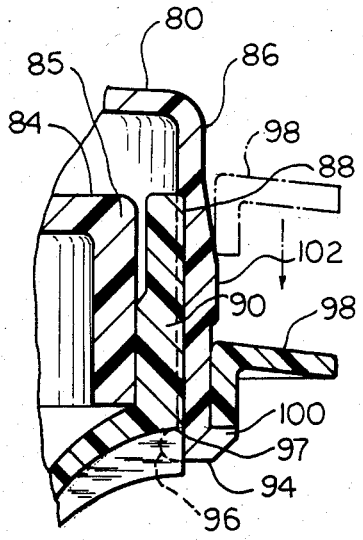
FIG 3

CENTRIFUGAL DISPENSER FOR AUTOMATIC WASHER WITH HIGH SPEED SPIN

BACKGROUND OF THE INVENTION

1. Field of the Invention

The present invention relates to a dispenser for an automatic washer and more particularly to a centrifugal dispenser automatically operable upon a high speed spin operation.

2. Description of the Prior Art

Centrifugal dispensers are known in the art and generally employ a cup-like structure which holds an additive during the washing and rinsing steps of an automatic washing program and which dispenses the additive during the spin portion when the additive is forced outwardly and upwardly along the walls of the cup structure into an area where it is released into the wash basket at the end of the spin cycle. Generally, these dispensers are attached to the top of the agitator by bolting them onto the agitator. For instance, U.S. Pat. No. 3,316,741 discloses a centrifugal dispenser which is secured to the top of the agitator by a nut and a plurality of tabs which snap over a shelf on the agitator. To remove the dispenser, which is often times desirable, would be very inconvenient with the dispenser disclosed in that patent.

U.S. Pat. No. 3,370,444 discloses a centrifugal rinse aid dispenser for use in an automatic washer in which the agitator reciprocates vertically during agitation. The dispenser locks to the agitator by means of a plurality of springs which cooperate with lugs on the agitator barrel. A screwing and unscrewing motion of the dispenser relative to the agitator effects a connection for holding the dispenser on the agitator. Such a attachment arrangement is not useful in an agitator which oscillates rather than reciprocates.

U.S. Pat. No. 3,620,054 discloses a two-part centrifugal rinse aid dispenser in which the inner, cup portion of the dispenser is secured to the top of the agitator by means of a stud and the outer portion of the dispenser snap-fits over the cup portion.

U.S. Pat. No. 4,118,957 discloses a centrifugal rinse aid dispenser which sits on top of the agitator and is retained in place by frictional engagement between inwardly projecting ribs on the dispenser and the upper portion of the agitator. While such an attachment means is sufficient to hold the dispenser on an automatic washer which operates for instance at an agitate rate of 68 strokes per minute and a spin rate of about 500 R.P.M., a new generation of washers is being produced which agitate at a rate of 180 strokes per minute and which spin at approximately 640 R.P.M. It has been found that the retaining means disclosed in U.S. Pat. No. 4,118,957 is not satisfactory for these high spin speed/high stroke rate machines because the dispenser can become dislodged from the agitator during operation of the machine.

SUMMARY OF THE INVENTION

The present invention provides a dispenser for an automatic washer with a high spin speed, on the order of approximately 640 R.P.M. in which the dispenser can be easily and readily removed from the agitator. In addition to an improved means for securing the dispenser to the top of the agitator, the present invention also provides improved means for preventing the accidental discharge of liquid during agitation or low-speed spinning.

The dispenser is secured to the top of the agitator by means of a deformable annular downwardly extending wall portion at the base of the dispenser and a cooperating locking ring which slides vertically along the deformable wall between a locked and released position. Thus, the dispenser can be used with washers which provide high speed spin and high stroke rate agitation since the dispenser cannot be thrown off the agitator due to the securement by the locking ring. Although the dispenser is very securely retained to the agitator in its use position, the dispenser can easily be removed from the agitator, by lifting on the locking ring, to facilitate loading and unloading of the clothes basket. Thus, the dispenser can be fabricated in an extremely simple manner and can be formed of inexpensive material and does not require springs or special fasteners to secure it to the agitator.

The configuration of the cup portion of the dispenser has been modified to prevent dispensing of the additive at a spin speed below approximately 300 R.P.M. Since some automatic washers initiate spinning at the beginning of a pump out operation, such that the agitator begins to rotate slowly with the clothes basket at the beginning of the pump out, with a speed of rotation increasing progressively during the pump out operation, it is necessary to prevent the dispensing of the additive at low spin speeds. When the washer is operated through a permanent press cycle, the tub is partially drained and refilled at the completion of the washing operation, before being completely pumped out. During this step in the wash cycle, the agitator may reach a spin speed of approximately 250 R.P.M. during this partial pump out; however, it is not desirable that the additive be centrifugally dispensed into the wash load at this time. The new generation of high spin speed washers have a low spin speed of approximately 425 R.P.M. and a high spin speed of approximately 640 R.P.M. and it is desirable to dispense the additive only at those speeds. Therefore, the shape of the dispenser cup is important to prevent dispensing the additive below speeds of approximately 300 R.P.M.

BRIEF DESCRIPTION OF THE DRAWINGS

FIG. 1 is a perspective view of an automatic washer embodying the principles of the present invention.

FIG. 2 is a side elevational view, partially cut away, showing the attachment of the dispenser to the agitator.

FIG. 3 is a partial side sectional view taken generally along the lines III—III of FIG. 2.

DESCRIPTION OF THE PREFERRED EMBODIMENTS

Figure 4:
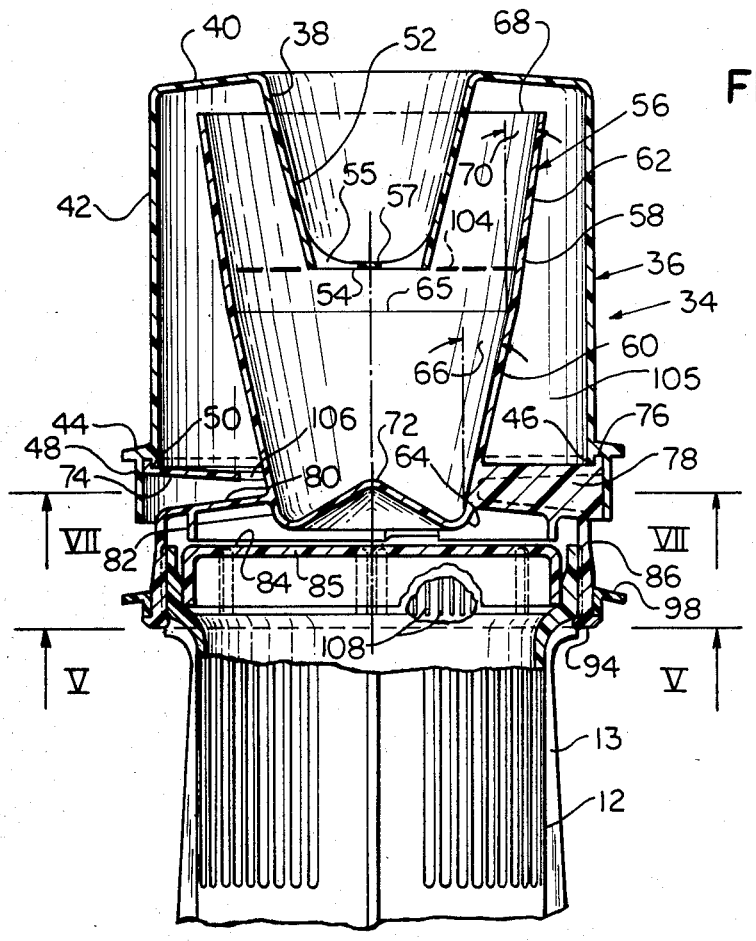
FIG. 4 is a sectional view of the dispenser embodying the principles of the present invention.

In FIG. 1 there is seen an automatic washer generally at 10 including a vertically mounted agitator 12 having radially extending vanes 13 and being concentrically mounted within a perforate wash basket 14 and an imperforate wash tub 16. The agitator 12 and basket 14 are driven by an electric motor 18 through a transmission 20. The washing machine is enclosed in a cabinet 22 including a top panel 24 with an openable lid 26 providing access to the interior of the wash basket 14. A plurality of controls 28 are provided including a control 30 for selecting a pre-programmed series of washing, rinsing and spinning steps. These controls 28, 30 are mounted on a console panel 32.

A centrifugally operated dispenser 34 is mounted on the top of the agitator 12 for dispensing an additive onto the clothes load within the basket 14 following a spin portion of the wash cycle. The dispenser 34 is shown in greater details in FIGS. 2–6.

Figure 7:
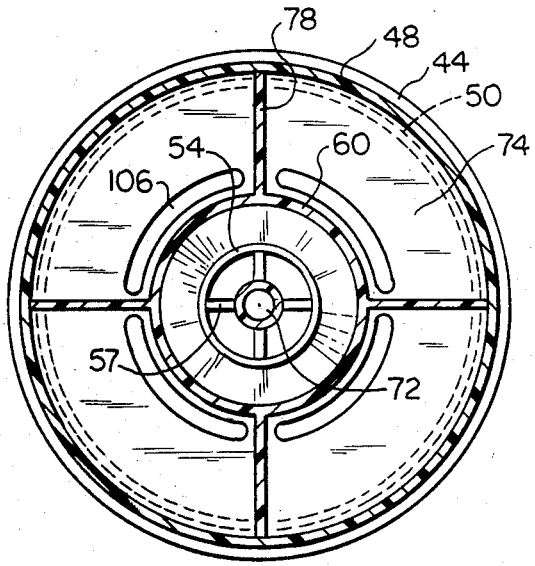
FIG. 7 is a bottom sectional view of the dispenser taken generally along the lines VII—VII of FIG. 4.

In FIGS. 2 and 4, the dispenser 34 is shown mounted on the top of the agitator 12. The dispenser 34 has a cover portion 36 which has, as seen in FIG. 4, a central opening 38 centered in an annular top wall 40 which is positioned at the top of an upstanding circumferential wall 42. The wall 42 extends downwardly to an outwardly extending lip 44 having a short portion 46 which extends downwardly below the lip 44. A second, slightly larger radius wall 48 continues downwardly from the lip 44 thus resulting in an annular groove 50 on the underside of the lip 44 between the short extension 46 and the circumferential wall 48. The top opening 38 includes a downwardly extending funnel shaped wall 52 which terminates at a bottom end 54 in a plurality of openings 55 between webs 57 (see FIG. 7) supporting the bottom end 54 of the funnel wall 52.

A second portion of the dispenser 34 is an inner cup member 56 which is used to hold the additive during the pre-wash, agitate and pre-spin portions of the wash cycle. The cup member 56 has a bifurcated circumferential wall 58 with a lower portion 60 extending upwardly and outwardly at a predetermined angle to hold a sufficient quantity of additive liquid. An upper portion 62 also extends upwardly and outwardly, but at a steeper angle to prevent premature dispensing of the rinse additive.

It has been found that a bottom portion height from a bottom wall 64 of the lower portion 60 to a junction 65 of the bottom portion 60 with the upper portion 62 of 55 millimeters along with an angle 66 of the lower wall 60 from vertical of 13½ degrees combined with an upper wall 62 height from the junction 65 between the wall portions to a top end 68 of the top wall 62 of 50 millimeters, along with an angle 70 of the top wall portion 62 from the vertical of 8½ degrees prevents dispensing of the additive below 300 R.P.M. but ensures complete dispensing of the additive above 400 R.P.M.

The bottom wall 64 of the lower cup wall 60 has a centrally raised or domed area 72 which prevents liquid from accumulating and remaining in the cup during the spin process. The raised portion 72 causes the liquid to flow radially outwardly toward the circumferential wall 60. The angle 66 of the bottom wall 62 ensures that all of the additive will be dispensed at a rotational speed above 400 R.P.M.

Near the bottom of the lower wall portion 60 is a radially outwardly extending ring wall 74 which extends outwardly to the inner surface of the lower circumferential wall 48 of the cover 36. The ring 74 has at its circumferential edge, an upstanding wall 76 which is captured within the annular grove 50 between the two walls 46 and 48. Since the dispenser portions can be advantageously made by injection molding with a plastic material such as polypropylene, the two portions, the outer cap 36 and the cup portion 56, can be secured together by spin welding or by the application of an adhesive between the annular upstanding wall 76 and the annular groove 50. In this manner, the two parts can be permanently locked in assembly.

The annular ring 74 projects outwardly from the lower cup wall 60 and upwardly at a slight angle such that the portion of the ring 74 adjacent to the cup wall 60 is at the lowest point. The ring 74 is supported at various points by vertical webs 78 extending downwardly from the ring 74 and being formed integrally with a lower outwardly extending wall 80. This lower wall 80 has a number of downwardly extending feet 82 which rest on a top surface 84 of an agitator cap 85 which is secured in the top of the agitator 12.

Figure 6:
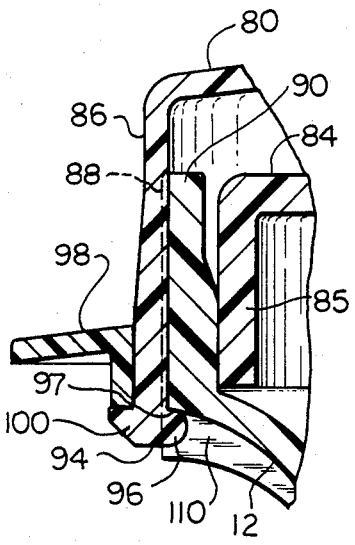
FIG. 6 is a partial sectional view taken generally along the lines VI—VI of FIG. 5.

The lower outwardly extending wall 80 continues outwardly to a downwardly depending annular wall 86 which frictionally engages an outer surface 88 of a cylindrical top end 90 of the agitator 12 as seen in detail in FIGS. 3 and 6. The annular downwardly depending wall 80 has a series of slots 92 (FIG. 2) extending from a bottom end 94 of the wall most of the way up to the top of the wall 86 near the radial wall 80. The slots 92 cause the wall 86 to be somewhat deformable in an advantageous manner.

Figure 5:
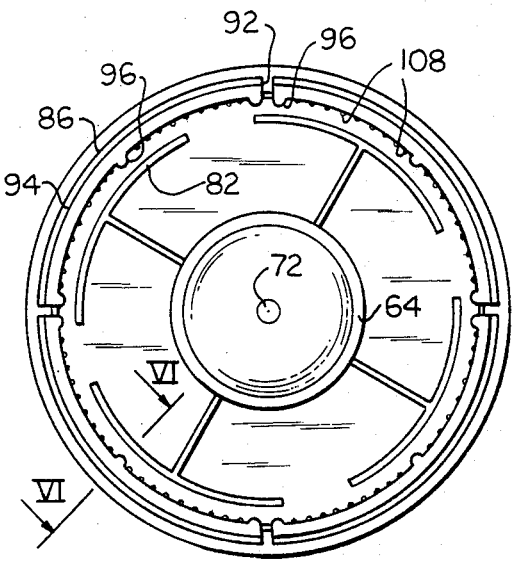
FIG. 5 is a bottom sectional view, of the dispenser only, taken generally along the lines V—V of FIG. 4.

As seen in FIG. 5, projecting radially inwardly from the bottom edge 94 of the wall 86 are a plurality of buttons 96 which slide over and are captured under a bottom edge or lip 97 of the outer surface 88 of the top end 90 of the agitator 12. This is seen in detail in FIG. 6. The buttons 96 provide a locking of the dispenser 34 onto the agitator 12. To ensure a positive locking of the dispenser 34 to the agitator 12, a locking ring 98 is provided to engage the outer circumferential surface of the wall 86 and is movable between a downward and locked position shown in FIG. 6 where the ring 98 abuts against an outwardly extending shoulder 100 at the bottom edge 94 of the wall 86 and an upper unlocked position shown in phantom in FIG. 3 where the ring is raised away from the bottom edge 94 and is positioned more closely to the radial wall 80.

To assist the ring 98 in ensuring a positive lock, the downwardly depending wall 86 has a downward and outward taper causing the ring 98 to radially compress the deformable wall 86 as it is pushed downwardly toward the shoulder 100. This ensures that the buttons 96 will be retained in a locking position beneath the lip 97 of the top end 90 of the agitator 12. There are also provided a plurality of friction pads 102 spaced around the circumference of the wall 86 which provide a number of functions. First, the pads 102 project outwardly sufficiently enough to retain the locking ring 98 above the pads 102 when the ring is in the unlocked position. This prevents the ring from inadvertently falling into the locked position. Secondly, the pads 102 prevent the ring 98 from moving upwardly away from the bottom edge 94 of the wall 86 to inadvertently unlock the dispenser 34 from the agitator. Also, the pads cause the ring 98 to provide a tactile indication of locking and unlocking when the user moves the ring between the locked and unlocked positions.

Prior to beginning the initiation of a wash load, but after the clothes have been added to the wash basket 14, the user would introduce a quantity of rinse additive to the dispenser 34 by pouring the liquid additive into the opening 38 in the top wall 40. The fill level 104 for the additive is even with the bottom edge 54 of the funnel wall 52 thus providing a readily determinable level for the user. If the user wishes to place a lesser amount of additive into the dispenser 34, water can be added through the opening 38 to bring the level of the liquid up to the fill level 104.

During the agitation washing phase, as the agitator 12 oscillates, the liquid additive will be forced upwardly against the upper walls 62 of the cup portion 58. However, because of the steep angle and height of the wall, the liquid will not reach the top edge 68 of the cup. However, during the true spin portion of the wash cycle, when the agitator rotates at a speed greater than 400 R.P.M., the liquid will flow up and over the top edge 68 of the cup 58 and will be flung against the inside face of the side circumferential wall 42 of the cap 36. The liquid additive would continue to be held against the inside face of wall 42 between the top wall 40 and the ring wall 74 while the agitator is in the high spin mode.

At the end of the spin mode, the agitator stops rotating while the basket 14 is filled with rinse water. When this occurs, the liquid additive will flow down onto the ring wall 74 which is angled downwardly toward the cup lower wall 60. At the inner edge of the ring wall 74 near the junction with the wall 60, there are provided a plurality of slots 106 through which the rinse additive can flow, whereupon the additive will be directed along the top of wall 80 and down into the interior of the basket which is being filled with the rinse water. Thus, the additive will be held in the cup until the agitator reaches a rotational speed of greater than 300 R.P.M., at which time the additive will begin to be transferred to a chamber 105 within the cover of the dispenser where it will be held until the agitator essentially stops rotating. Only at that time will the additive be dispensed into the wash basket.

The dispenser 34 can be easily removed from the agitator 12, as may be desirable when the user is loading or unloading clothes from the wash basket. By grasping the locking ring 98 and pulling upwardly, the force holding the buttons 96 under the agitator lip 97 will be removed and as the ring 98 is continued to be lifted upwardly against the bottom edge of the lower cap wall 48, the entire dispenser 34 will lift clear of the agitator. Locking the dispenser 34 onto the agitator is just as easy. The dispenser is slipped on to the top of the agitator and the ring is pushed downwardly until the user feels the snap of the ring 98 passing the friction pads 102. The snap feel will ensure that the dispenser 34 is securely axially locked to the agitator 12.

Not only is it necessary to prevent axial movement of the dispenser 34 on the agitator 12 during the washing cycle, it is also necessary to prevent relative rotational movement between the dispenser 34 and the agitator. This is especially true in a high stroke rate agitator which may have stroke rates on the order of 180 strokes per minute which could easily dislodge the dispenser from the agitator if there was relative movement therebetween. To prevent any relative rotational movement, the top end 90 of the agitator is provided with a number of radially outwardly extending vertical ribs 106 which engage in spaces between ribs 108 formed in the inside face of the downwardly depending wall 86. Further, if the user installs the dispenser such that the slots 92 are in registration with the top portions 110 of the vanes 13, which extend upwardly under the top end 90 of the agitator, then the buttons 96 adjacent the slots 92 will laterally engage the vane portions 110. In this manner, the buttons 96 laterally engaging with the vane tops 110 and the slots 108 engaging with the ribs 106 provide maximum coupling of the dispenser with the agitator, to thereby ensure that the additive dispenser 34 corotates with the agitator, even during the agitate mode when the agitator is oscillating at speeds up to 180 strokes per minute. It is not, however, absolutely necessary that the dispenser be installed in such a registered fashion.

It is thus seen that the present invention provides a rinse additive dispenser operated by centrifugal force which prevents premature dispensing of the additive and which can be easily and quickly secured to the agitator, both axially and rotationally without the need for additional fasteners. The dispenser can also be quickly and easily removed by a user even though means are provided to securely lock the dispenser onto the agitator to prevent it from dislodging during high speed spin and high stroke rate agitation.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

Having described the invention, the embodiments of the invention in which an exclusive property or privilege is claimed are defined as follows:

1. A rinse additive dispenser for an automatic washer having a vertical oscillating agitator concentrically mounted in a wash basket comprising:

a cup portion for retaining a liquid additive, a cover portion enclosing said cup and having a top opening above said cup;

wall means connecting said cup and said cover;

annular wall means coupled to said cup for engaging a cylindrical top end of said agitator;

first retaining means formed on said annular wall for engaging a portion of said agitator to hold said dispenser on said agitator;

selectively movable locking means carried on said annular wall for holding said retaining means against said agitator; and, second retaining means formed on said annular wall for engaging said movable locking means and to retain it in either a locked or unlocked position depending on the position of said locking means;

whereby said dispenser can be locked onto said agitator for use and unlocked for removal.

2. The device of claim 1 wherein said cup portion has substantially vertical walls angled slightly outwardly towards an open top end to permit liquid therein to be dispensed during a spin mode due to centrifugal force acting on said liquid urging it outwardly over the open top of said cup.

3. The device of claim 2 wherein the walls of said cup are angled and dimensioned to prevent the dispensing of liquid from said cup at rotational speeds below 300 R.P.M.

4. The device of claim 2 wherein said cup, cover and connecting wall form a chamber to retain said liquid after it has left the cup during the spin mode.

5. The device claim 4 wherein said connecting wall is sloped downwardly from said cover to said cup and plurality of aperatures are provided through said wall adjacent to said cup to permit the passage of liquid from said chamber into said basket after said spin mode.

6. The device of claim 1 wherein said cup portion has a lower circumferential wall portion extending upwardly and outwardly at a first preselected angle from the vertical and an upper circumferential wall portion extending upwardly and outwardly at a second preselected angle from the vertical which is smaller than said first angle.

7. The device of claim 6 wherein said first preselected angle is approximately 13½ degrees and said second preselected angle is approximately 8½ degrees.

8. The device of claim 6 wherein said funnel walls extend downwardly into said cup to define a fill level within said cup.

9. The device of claim 1 wherein said cover opening has funnel shaped walls for directing liquid into said cup.

10. The device of claim 1 wherein said annular wall is made deformable by vertical slots extending upwardly from a bottom end thereof to assist in the engagement of said retaining means with said agitator.

11. The device of claim 1 wherein said first retaining means comprise radially inwardly projecting buttons formed on an inner surface of said annular wall for engaging the underside of a lip on said agitator.

12. The device of claim 11 wherein said locking means comprises a ring captured on said annular wall, said annular wall having a greater outer circumference opposite said buttons thereby resulting in said buttons being urged inwardly when said ring is moved to overlie said greater circumferential area.

13. The device of claim 1 including means for preventing relative rotational movement between said dispenser and said agitator.

14. The device of claim 13 wherein said anti-rotational means comprise engaging vertical ribs formed on said agitator and said annular wall.

15. The device of claim 1 wherein said locking means comprises a ring captured on said annular wall and said second retaining means comprises outwardly projecting pads engagable by said ring.

16. For use in an automatic washer having a vertical axis oscillating agitator concentrically mounted in a wash basket to rotate with said basket in a spin mode, said agitator having a cylindrical top end with a solid top and an annular lip formed below said top end, a rinse additive dispenser comprising:

a cup portion for retaining a liquid additive and having substantially vertical walls angled slightly outwardly towards an open top end to permit liquid therein to be dispensed during said spin mode by centrifugal force;

a cover portion enclosing said cup and having a top opening above said cup with downwardly extending funnel shaped walls for directing liquid into said cup;

wall means connecting said cup and said cover to form a chamber for retaining said liquid after it has left said cup during said spin mode, said wall sloping downwardly from said cover to said cup and having a plurality of apertures therethrough adjacent said cup providing communication between said chamber and said wash basket to permit the passage of liquid from said chamber into said basket after said spin mode;

downwardly extending annular wall means coupled to said cup for engaging said cylindrical top end of said agitator;

retaining means comprising radially inwardly projecting buttons formed on an interior surface of said annular wall to engage below said annular lip on said agitator;

a selectively movable locking ring captured on said annular wall means for holding said buttons below said lip in a locked position;

said annular wall means having vertical slots extending upwardly from a bottom end thereof and a greater circumference opposite said buttons thereby resulting in said buttons being urged inwardly when said ring is moved to said locked position to overlie said greater circumferential area.

17. The device of claim 16 wherein said walls of said cup are angled and dimensioned to prevent the dispensing of liquid from said cup at rotational speeds below 300 R.P.M.

18. The device of claim 16 wherein said funnel walls extend downwardly into said cup to define a fill level within said cup.

19. The device of claim 16 wherein said annular wall means further includes support means for engaging said solid top of said agitator.

20. The device of claim 16 wherein said annular wall means further includes radially outwardly projecting pads for retaining said ring in a locked position.

21. For use in an automatic washer having a vertical axis oscillating agitator concentrically mounted in a wash basket to rotate with said basket in a spin mode, said agitator having a cylindrical top end and an annular lip formed below said top end, a rinse additive dispenser comprising:

a cup portion for retaining a liquid additive and having substantially vertical walls angled slightly outwardly towards an open top end to permit liquid therein to be dispensed during said spin mode by centrifugal force;

downwardly extending annular wall means coupled to said cup portion for engaging said cylindrical top end of said agitator;

retaining means formed on said annular wall for engaging a portion of said agitator to hold said dispenser on said agitator;

selectively movable locking means carried on said annular wall for holding said retaining means against said agitator; and, second retaining means formed on said annular wall for engaging said movable locking means and to retain it in either a locked or unlocked position depending on the position of said locking means;

whereby said dispenser can be locked onto said agitator for use and unlocked for removal.

22. An attachment means for a dispenser used with an automatic washer having a vertical axis agitator with a cylindrical top end comprising:

a deformable annular wall extending downwardly from said dispenser, the inner diameter of said wall being slightly larger than said agitator top end such that said wall can be slipped over said agitator in a telescoping manner, the outer diameter of said wall increasing in a downwardly direction, and the bottom end of said wall having a outwardly projecting shoulder and inwardly projecting protusions, a lip formed on said agitator spaced below said top end to receive said inwardly projecting protrusions, and a locking ring member movably held about said annular wall above said shoulder and having an inner diameter slightly larger than said outer diameter of said annular wall at a top end thereof, but smaller than said outer diameter of said annular wall at said bottom end, whereby, as said ring member is moved downwardly around said annular wall, said wall is deformed inwardly thus holding said protrusions below said lip.

23. The device of claim 22 wherein said annular wall further includes outwardly projecting pads spaced intermediately between said top and bottom ends of said annular wall to hold said locking ring member in an up or down position.

24. The device of claim 22 wherein said annular wall and said agitator top end further include engaging vertical ribs to prevent rotation between said two parts.

25. The device of claim 22 wherein said locking means comprises a ring captured on said annular wall and said second retaining means comprises outwardly projecting pads engagable by said ring.

* * * * *